United States Patent [19]

Benjamins

[11] 4,387,303

[45] Jun. 7, 1983

[54] RADIOISOTOPE GENERATOR

[75] Inventor: Harm M. Benjamins, Den Helder, Netherlands

[73] Assignee: Byk-Mallinckrodt CIL B.V., Petten, Netherlands

[21] Appl. No.: 209,980

[22] PCT Filed: Mar. 25, 1980

[86] PCT No.: PCT/NL80/00009

§ 371 Date: Nov. 24, 1980

§ 102(e) Date: Nov. 24, 1980

[87] PCT Pub. No.: WO80/02082

PCT Pub. Date: Oct. 2, 1980

[30] Foreign Application Priority Data

Mar. 26, 1979 [NL] Netherlands ..... 7902342

[51] Int. Cl.[3] ..... G21G 1/04

[52] U.S. Cl. ..... 250/432 PD; 141/DIG. 2

[58] Field of Search ..... 250/432 PD, 432 R; 141/DIG. 2

[56] References Cited

U.S. PATENT DOCUMENTS

| | | | |
|---|---|---|---|
| 3,369,121 | 2/1968 | Bruno et al. . | |
| 3,462,245 | 8/1969 | Eudes et al. . | |
| 3,535,085 | 10/1970 | Shumate . | |
| 3,564,256 | 2/1971 | Arlman . | |
| 3,576,998 | 5/1971 | Deutsch . | |
| 3,655,981 | 4/1972 | Montgomery et al. | 20/432 PD |
| 3,710,118 | 1/1973 | Holgate et al. . | |
| 3,774,035 | 11/1973 | Litt | 250/432 PD |
| 3,920,995 | 11/1975 | Czaplinski et al. | 250/432 PD |
| 3,986,537 | 10/1976 | Wilhere | 141/DIG. 2 |
| 4,276,256 | 7/1978 | Karamian | 250/432 R |

*Primary Examiner*—Alfred E. Smith
*Assistant Examiner*—Carolyn E. Fields
*Attorney, Agent, or Firm*—Bernard, Rothwell & Brown

[57] ABSTRACT

Disclosed is a radioisotope generator useful in the process of eluting a daughter radioisotope from an adsorbed parent radioisotope. The radioisotope generator comprises a column containing carrier material adapted to adsorb the parent radioisotope and including an inlet opening and an outlet opening. The outlet opening of the column is connected to a tapping point on the generator by an eluate conduit, the tapping point adapted to receive an evaluated elution vial so that a liquid eluate containing the daughter radioisotope can be obtained from the generator under vacuum. The generator further includes a device for interrupting the elution process before the elution vial is entirely filled while simultaneously exposing the generator to sterile air both in the direction of the generator column and of the elution vial.

11 Claims, 3 Drawing Figures

RADIOISOTOPE GENERATOR

The present invention relates generally to radioisotope generators and, more specifically, to radioisotope generators containing means for interrupting an elution process being conducted in the generator.

Radioisotope generators are apparatuses used in obtaining a solution of a daughter radioisotope such as technetium-99 m from an adsorbed parent radioiotope such as molybdenum-99 which produces the daughter radioisotope upon radioactive decay. The solution of the daughter radioisotope may be used by the medical profession for diagnostic purposes.

Conventionally, radioisotope generators include a column containing the parent radioisotope adsorbed on a carrier material such as an anion exchange medium or other medium such as alumina which has high adsorptive capacity for the parent radioisotope but a low adsorptive capacity for the daughter radioisotope. To obtain the desired daughter radioisotope, the column is eluted by washing with a suitable solvent or eluant such as a sterile saline solution. The resulting eluate containing the daughter radioisotope in the form of a dissolved salt is useful as a diagnostic agent, for example, and is adapted for intravenous administration.

To obtain a quantity of the eluate from the generator in a simple and safe manner, a vessel containing a quantity of eluant can be connected to the inflow side of the column and an evacuated elution vial connected to the outflow side of the column at a tapping point on the generator. The vacuum in the evacuated vial draws the eluant from the vessel, through the column and into the vial thereby eluting the daughter radioisotope from the column.

These evacuated eluation vials are generally surrounded by a lead shield for safety purposes and further include a label and a sealing assembly comprising a rubber stopper and flanged metal cap. The rubber stopper allows the vial to be connected at the tapping point of the generator by piercing with a needle contained in the tapping point. The vials may have, for example, standard volumes of about 10, 15 or 23 ml. For certain purposes, smaller volumes are necessary and therefore, sets of elution vials are often used. For example, sets having standard elution volumes of 23, 15, 4.8 and 3.0 ml; 15, 10 and 5 ml; or of 10 and 5 ml have been used. With the smaller vials, a fractionated elution can be conducted so that a higher concentration of daughter radioisotope in the eluate can be obtained. Such a high radioisotope concentration is required, for example, for bolus injections.

However, the use of a set of elution vials of various standard volumes with a radioisotope generator has significant disadvantages associated therewith. For example, up to four different types of vials as well as their associated labels, rubber stoppers, flanged metal caps and lead shields must be kept in stock. For shipping, packaging must be adapted to the different dimensions of the vials. Moreover, upon completion of an elution in the radioisotope generator, the vial is always entirely filled with liquid so that drawing of the eluate from the vial by an injection syringe is impeded. Finally, with regard to the volume of the eluate and hence the level of the concentration of the daughter radioisotope, there are only restricted choices, for example, two, three or four possibilities. As a consequence, a radioisotope generator system in which a set of elution vials is used has limited flexibility in terms of elution volume and radioisotope concentration.

In order to avoid the above-mentioned disadvantages, it has been proposed that a standard elution vial having a relatively large volume be also used for collecting smaller quantities of eluate, for example, 10 or 15 ml. To collect a smaller quantity of eluate in such a large standard vial, the elution process in interrupted before the vial is completely filled by withdrawing the vacuum vial from the tapping point of the generator. As a consequence, the vacuum within the elution vial is dissipated. A significant disadvantage of this method is that non-sterile air is drawn into both the vacuum vial and the generator, the exposure of the eluate to non-sterile air being pharmaceutically unacceptable.

A radioisotope generator has also been developed in which the eluate conduit from the column can be closed in the proximity of the tapping point by a stopcock or valve when the required quantity of eluate has been obtained in an evacuated elution vial. Once the eluate conduit has been closed, the evacuated vial is removed from the tapping point. However, upon removal, the evacuated vial may continue to draw if the vial is not completely filled and thus non-sterile air may be drawn in. Consequently, the resultant eluate will be pharmaceutically unacceptable due to the contact with non-sterile air. Moreover, the stopcock or valve in the eluate conduit is controlled by an operating member which is located outside the protective housing of the generator. The operating member is therefore quite vulnerable to damage since its projects outwardly of the generator housing. Furthermore, because the operating member projects through an aperture in the generator housing, the generator cannot be hermetically sealed which is contrary to the regulations imposed for the shipment of generators containing radioisotopes.

An example of the latter type of radioisotope generator is set forth in U.S. Pat. No. 3,710,118 to Helgate et al. In the disclosed generator, a flexible eluate conduit passes through an aperture in the sidewall of a hollow plunger slideably mounted in the generator housing and communicates with an injection needle carried by the end of the plunger. The other end of the plunger comprises an operating knob which projects beyond the exterior of the generator housing. The plunger is biased to a retracted position by a coil type compression spring which thereby pinches off the eluate conduit between a boss on the housing and projecting collar on the plunger. During an elution process, the plunger is depressed against the action of the spring so that the injection needle pierces an evacuated elution vial and eluate flows through the eluate conduit and into the vial. The elution process can be interrupted by allowing the plunger to return to the retracted position under the influence of the spring which thereby withdraws the needle from the elution vial and pinches off the eluate conduit between the boss and the projecting collar. However, upon withdrawal of the injection needle, the eluate in the elution vial is simultaneously exposed to non-sterile air. Consequently, this generator suffers from the same disadvantage as state in the preceding paragraph.

Thus, in all of the last-mentioned generators, the disadvantage of the lack of flexibility has been eliminated but other serious disadvantages, in particular, the contamination of the collected eluate with non-sterile air, have been added to the operation of the generator.

An object of the present invention is to provide a radioisotope generator which minimizes or even completely eliminates the above-mentioned disadvantages. Briefly, the radioisotope generator in accordance with the present invention comprises a column containing carrier material for a parent radioisotope, said column including an inlet opening and an outlet opening, the outlet opening connected to a tapping point by an eluate conduit, the tapping point adapted to receive an evacuated elution vial so that a liquid eluate comprising the daughter radioisotope can be obtained from the generator under vacuum and means for interrupting the elution process before an elution vial is entirely filled with eluate while providing the generator, both in the direction of the generator column and of the elution vial, with a simultaneous exposure to sterile air. As a consequence, a sterile, pharmaceutically acceptable eluate in any quantity desired can be obtained and, in addition, the interior of the generator will not become contaminated with non-sterile air when the elution process is interrupted.

The means adapted to interrupt the elution process preferably is constructed so that the hermetic seal of the generator housing required for shipment can be maintained. In a preferred embodiment, the entire means including associated actuating portion is located entirely within the housing of the generator. For simple operation of the generator, it is particularly preferred that the means be constructed so that the elution process can be interrupted by a movement of the evacuated elution vial produced, for example, by exerting downward pressure on the vial.

The means for interrupting the eluation process in an isotope generator preferably comprises an air inlet conduit which communicates with the eluate conduit and through which sterile air can be drawn into the eluate conduit when the air inlet conduit is open and means for opening and closing the air inlet conduit. A particularly preferred means for interrupting the elution process is one in which the air inlet conduit communicating with the eluate conduit is opened and closed by mechanical means, most preferably, by the action of a rod biased by a spring. In a particularly preferred embodiment, the means for opening and closing the air inlet conduit is capable of being pushed away or depressed against the bias of a spring by a force exerted by the elution vial so as to open the air inlet conduit and simultaneously discontinue the elution process.

The present invention will be described in greater detail with reference to several preferred embodiments thereof shown in the accompanying drawings.

Figure 1:
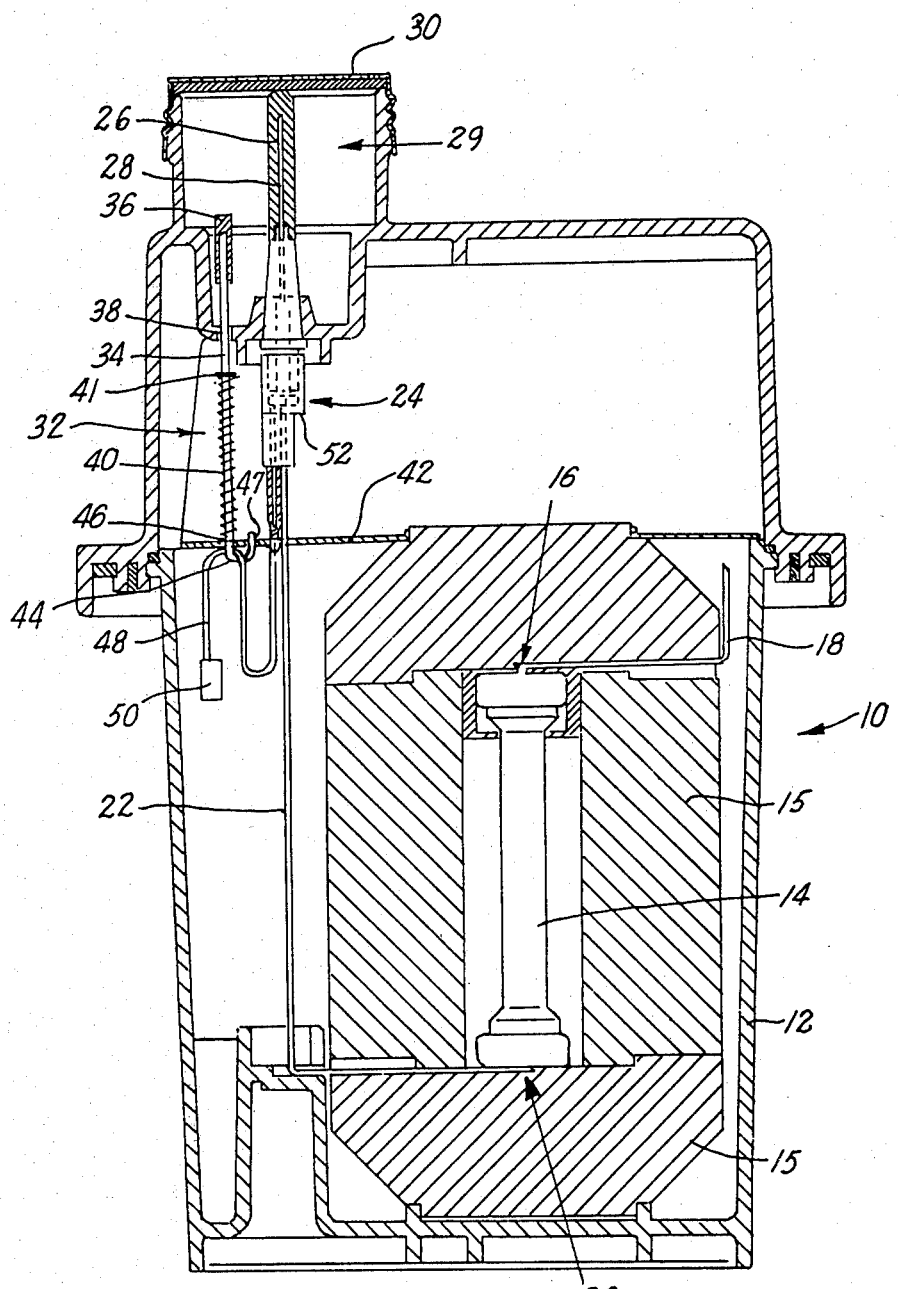
FIG. 1 is a cross-sectional view of a radioisotope generator in accordance with the present invention which includes one embodiment of a means for interrupting the elution process.

Referring now to FIG. 1, shown is radioisotope generator 10 comprising housing 12 which encloses generator 10, and surrounding lead container 15. On the upper portion of column 14 is inlet aperture 16 for eluant flowing from an eluant reservoir (not shown) through eluant conduit 18. On the lower portion of column 14 is outlet aperture 20 to which eluate conduit 22 is connected. Conduit 22 connects column 14 with tapping assembly 24 which includes injection needle 26 surrounded by a removable needle sheath 28. Injection needle 26 of assembly 24 projects from generator housing 12 into tapping point 29 adapted to retain an evacuated elution vial (not shown). For shipment of generator column 14, tapping point 29 is hermetically sealed by a clamp or screw type cap 30, preferably a pilfer-proof type cap.

Included within generator housing 12 is means 32 adapted for interrupting an elution process being conducted in generator 10. In the embodiment shown, means 32 comprises rod 34 having actuating end 36 projecting into tapping point 29 through aperture 38 in housing 12. Helical spring 40 about rod 34 engages stop 41 on the rod and supporting plate 42 so as to bias the rod towards tapping point 29. End portion 44 of rod 34 opposite end 36 projects downwardly through aperture 46 in supporting plate 42 and is in a U-shape so that the distal end of the rod projects back through aperture 47 in the supporting plate. Air inlet conduit 48 having sterilization filter 50 at one end passes through U-shaped end portion 44 of rod 34 and is connected at the other end to eluate conduit 22 by branched pipe 52.

Since rod 34 is slidable in apertures 46 and 47 in supporting plate 42 and since air inlet conduit 48 is of a flexible type material, the action of spring 40 on the rod pinches off or closes the air inlet conduit by compressing the conduit between U-shaped end portion 44 of the rod and the supporting plate. Downward movement of rod 34 against the bias of spring 40 releases the pinching action and allows sterile air to flow through air inlet conduit 48.

Although end 36 of rod 34 which functions as the actuating portion of means 32 projects through aperture 38 to tapping point 29 of housing 12, it is evident from FIG. 1 that, as a result of screw cap 30 being a pilfer-proof cap which hermetically closes the tapping point of generating housing, means 32 is located entirely within the hermetically sealed housing of generator 10 and thus the generator complies with applicable regulations for the shipment of radioisotope generators.

Figure 2:
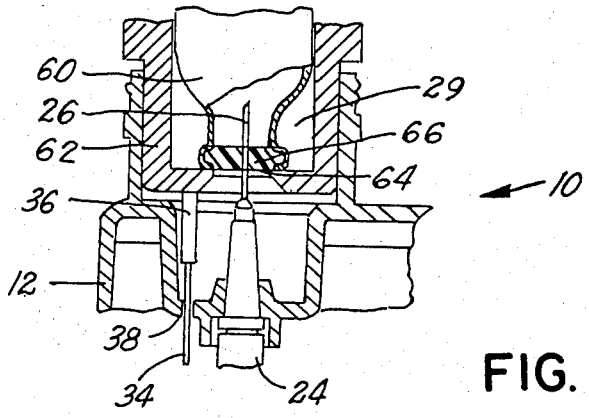
FIG. 2 is a partial cross-sectional view which illustrates the actuation of the means of FIG. 1 by a shielded elution vial.

The operation of generator 10 including means 32 in an elution process can be more easily explained with reference to both FIGS. 1 and 2. Initially, screw cap 30 is removed from housing 12 and then, immediately prior to the elution of generator column 14, needle sheath 28 is removed from needle 26. If, however, generator 10 has already been used for an elution process, a vial containing bacteriostat (not shown) has usually replaced needle sheath 28 and therefore this vial will be removed rather than the sheath. Vacuum eluate collecting vial 60 having protective lead shield 62 is prepared for filling with eluate by bending back the lug (not shown) from flanged closing cap 64 so as to expose rubber stopper 66 and then placing the vial upside down in tapping area 29 of generator housing 12 so that injection needle 26 pierces the rubber stopper of the vial. As shown in FIG. 2, shield 62 of elution vial 60 bears on actuating end 36 of rod 34 during the elution process but does not depress the rod. Since air inlet conduit 48 is pinched off by rod 34, eluate is drawn from column 14 into vial 60 due to the vacuum in the vial. The quantity of eluate collected in elution vial 60 can be determined visually if shield 62 of the vial has a lead glass window (not shown). The elution process can be interrupted at any time by simply pushing elution vial 60 downwardly against actuating end 36 of rod 34. Since rod 34 is slidably mounted in apertures 46 and 47, the rod is thereby lowered against the bias of spring 40 so that the pinching off or closing of air inlet conduit 48 ceases and air can now pass therethrough. Generator column 14, eluate conduit 22, and elution vial 60 are now all simultaneously exposed to sterile air drawn in through filter 50, conduit 48 and branched pipe 52 and the elution process thereby stops.

Figure 3:
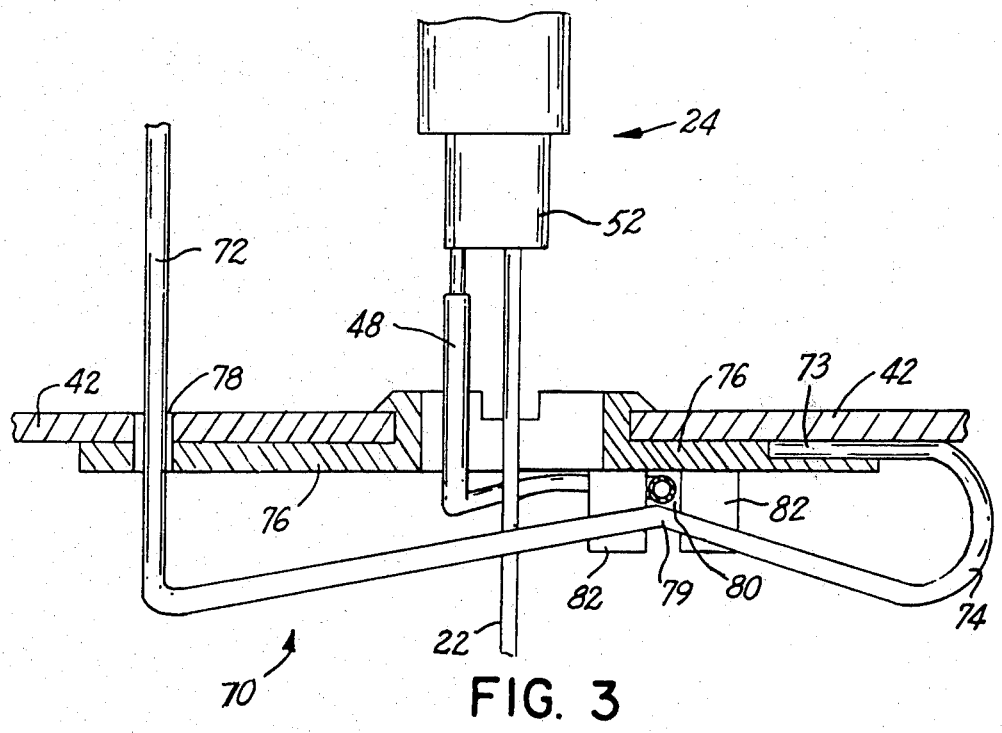
FIG. 3 is another partial cross-sectional view which illustrates another embodiment of a means for interrupting the elution process in a radioisotope generator.

Another embodiment of a means for interrupting the elution process in a radioisotope generator is shown in FIG. 3 which is partial cross-sectional view of a radioisotope generator including eluate conduit 22, needle assembly 24, supporting plate 42 and air inlet conduit 48 as in the generator of FIG. 1. In this embodiment, means 70 for interrupting an elution process comprises rod 72 of a resilient material which is bent at its lower end portion 74 to form a spring biasing the rod upwardly. The distal end 73 of lower end portion 74 of rod 72 is fixed in supporting member 76 mounted on supporting plate 42. Rod 72 passes through aperture 78 in supporting plate 42 and supporting member 76 and its upper end (not shown) projects into a tapping area (not shown) similar to that of FIG. 1. Air inlet conduit 48 is pinched off or closed between bent intermediate portion 79 of rod 72 and recess 80 in supporting member 76 formed by a plurality of downwardly projecting ears 82 which guide the rod and the conduit. When rod 72 which is slidably mounted in the generator housing (not shown) and in aperture 78 of supporting member 76 is pushed downwardly against its own spring bias by a shielded elution vial (not shown) in the same manner as described above, the pinching off or closure of conduit 48 is interrupted so that the generator and elution vial are thereby exposed to sterile air drawn through a sterilization filter (not shown) and air inlet conduit 48.

Thus, in its preferred embodiments, the present invention provides means for interrupting the elution process at any given moment by pressing an elution vial downwardly against the bias of a spring which thereby introduces sterile air into the elution vial. Furthermore, the capability for hermetic closure of the complete generator is not hindered by the inclusion of the interrupting means.

While the present invention has been described with reference to particular embodiments thereof, it will be understood that numerous modifications may be made without departing from the spirit and scope of the invention.

What is claimed is:

1. A radioisotope generator comprising a column containing carrier material adapted to adsorb a parent isotope, said column including an inlet opening and outlet opening, the outlet opening connected to a tapping point by an eluate conduit, the tapping point adapted to receive an evacuated elution vial so that a liquid eluate containing a daughter radioisotope can be obtained from the generator under vacuum, characterized in that the generator includes means for interrupting the elution process before the elution vial is entirely filled, said interrupting means simultaneously exposing the generator to sterile air both in the direction of the generator column and of the elution vial.

2. A radioisotope generator in accordance with claim 1, characterized in that the means for interrupting the elution process is constructed such that a housing for the generator is therefor hermetically sealed for shipping.

3. An isotope generator in accordance with claim 2, characterized in that the means for interrupting the elution process is provided entirely within the housing of the generator.

4. A radioisotope generator in accordance with claim 3, characterized in that the means for interrupting the elution process is constructed so that the elution is therefor interrupted by movement of the elution vial.

5. A radioisotope generator in accordance with claims 1, 2, 3, or 4, characterized in that the means for interrupting the elution process comprises and air inlet conduit which communicates with the eluate conduit and means for selectively opening and closing the air inlet conduit.

6. A radioisotope generator in accordance with claim 5, characterized in that the means for opening and closing the air inlet conduit operates mechanically.

7. A radioisotope generator in accordance with claim 6, characterized in that the means for opening and closing the air inlet conduit includes a biasing spring.

8. A radioisotope generator in accordance with claim 7, characterized in that the means for selectively opening and closing the air inlet conduit comprises a slidable rod having one end extending into the tapping point and adapted to be contacted by an elution vial, a portion of the rod remote from the end being biased against the air inlet conduit to close the air inlet conduit, said means opening said air inlet conduit upon a movement of the elution vial against the end of the rod.

9. A radioisotope generator in accordance with claim 8, characterized in that the rod portion is in a U-shape.

10. A radioisotope generator in accordance with claim 8, characterized in that the rod portion is in the form of a spring.

11. A device for interrupting an elution process in a radioisotope generator including a column containing carrier material adapted to adsorb a parent isotope, characterized in that the device includes means for interrupting the elution process before an elution vial is entirely filled while simultaneously exposing the generator to sterile air both in the direction of the generator column and of the elution vial.

* * * * *